US009365051B2

(12) United States Patent
Saksa et al.

(10) Patent No.: US 9,365,051 B2
(45) Date of Patent: Jun. 14, 2016

(54) APPLYING ELECTRIC FIELDS TO ERASE REGIONS OF A PRINT MEDIUM

(71) Applicant: Hewlett-Packard Development Company, L.P., Houston, TX (US)

(72) Inventors: Thomas A. Saksa, Corvallis, OR (US); Raymond Adamic, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 0 days.

(21) Appl. No.: 14/648,088

(22) PCT Filed: Nov. 30, 2012

(86) PCT No.: PCT/US2012/067280

§ 371 (c)(1),
(2) Date: May 28, 2015

(87) PCT Pub. No.: WO2014/084844

PCT Pub. Date: Jun. 5, 2014

(65) Prior Publication Data

US 2015/0343798 A1 Dec. 3, 2015

(51) Int. Cl.

| | |
|---|---|
| ***B41J 2/015*** | (2006.01) |
| ***B41J 11/00*** | (2006.01) |
| ***B41J 29/26*** | (2006.01) |

(52) U.S. Cl.
CPC ..... *B41J 11/0015* (2013.01); *B41J 29/26* (2013.01)

(58) Field of Classification Search
CPC ..... B41J 2202/02; B41J 2/14; B41J 2/04; B41J 2/211; B41J 2/2114
USPC ..... 347/21
See application file for complete search history.

(56) References Cited

U.S. PATENT DOCUMENTS

| | | | |
|---|---|---|---|
| 3,607,255 | A | 9/1971 | Back |
| 3,921,527 | A | 11/1975 | Raschke et al. |
| 4,020,762 | A | 5/1977 | Peterson |
| 6,045,955 | A | 4/2000 | Vincent |
| 6,796,237 | B2 | 9/2004 | Schuster et al. |
| 6,937,357 | B1 | 8/2005 | Vincent et al. |
| 2004/0004655 | A1 | 1/2004 | Kamoshida et al. |
| 2007/0159517 | A1 | 7/2007 | Hashimoto et al. |

(Continued)

FOREIGN PATENT DOCUMENTS

| | | | |
|---|---|---|---|
| CN | 2629069 | Y | 7/2004 |
| EP | 1162496 | | 12/2001 |
| JP | 2000229437 | A | 8/2000 |

(Continued)

OTHER PUBLICATIONS

International Search Report and Written Opinion, Aug. 13, 2013, PCT Patent Application No. PCT/US2012/067280.

*Primary Examiner* — Alessandro Amari
*Assistant Examiner* — Yaovi Ameh
(74) *Attorney, Agent, or Firm* — HP Inc. Patent Department

(57) ABSTRACT

In an embodiment, an ink erasing system includes an erase fluid dispenser to apply erase fluid to a surface of a print medium. The system includes a plurality of nonadjacent pairs of electrodes positioned across a width of the print medium. The system also includes a controller to direct the erase fluid dispenser to apply the erase fluid in an erase region on the print medium, and to alternately electrify the nonadjacent pairs of electrodes to generate a moving electric field through the erase region.

9 Claims, 12 Drawing Sheets

(56) References Cited

U.S. PATENT DOCUMENTS

| | | | | |
|---|---|---|---|---|
| 2007/0228005 | A1 | 10/2007 | Hasegawa et al. | |
| 2014/0055540 | A1 * | 2/2014 | Adamic | B41J 2/21 347/101 |

FOREIGN PATENT DOCUMENTS

| | | | |
|---|---|---|---|
| JP | 2004-160911 | | 10/2007 |
| JP | 2009-288290 | | 12/2009 |
| WO | WO-0043835 | A1 | 7/2000 |

* cited by examiner

APPLYING ELECTRIC FIELDS TO ERASE REGIONS OF A PRINT MEDIUM

CROSS-REFERENCE TO RELATED APPLICATION

This application is a U.S. National Stage Application of and claims priority to International Patent Application No. PCT/US2012/067280, filed on Nov. 30, 2012, and entitled "APPLYING ELECTRIC FIELDS TO ERASE REGIONS OF A PRINT MEDIUM," which is hereby incorporated by reference in its entirety.

BACKGROUND

Inkjet printers that produce images such as text, graphics, and pictures on a variety of media are in widespread use, and range from small consumer models to large commercial models. Fluid ejection devices (i.e., printheads) in inkjet printers provide drop-on-demand ejection of ink and other fluid drops through nozzles that are typically arranged into one or more nozzle arrays. Properly sequenced ejections of ink drops from the nozzles causes characters or other images to be printed on paper, for example, as printheads and the paper move relative to each other. In a specific example, a thermal inkjet printhead ejects drops from a nozzle by passing electrical current through a heating element to generate heat and vaporize a small portion of the fluid within a firing chamber. In another example, a piezoelectric inkjet printhead uses a piezoelectric material actuator to generate pressure pulses that force ink drops out of a nozzle.

In some circumstances, it may be beneficial to erase inkjet inks from paper and other media. However, once inkjet ink dries on paper it becomes well established and can be difficult to effectively and efficiently erase from the paper. Efforts to improve the effectiveness and efficiency with which inkjet inks can be erased from paper and other media are ongoing.

BRIEF DESCRIPTION OF THE DRAWINGS

The present embodiments will now be described, by way of example, with reference to the accompanying drawings, in which.

Throughout the drawings, identical reference numbers designate similar, but not necessarily identical, elements.

DETAILED DESCRIPTION

Overview

Figure 1:
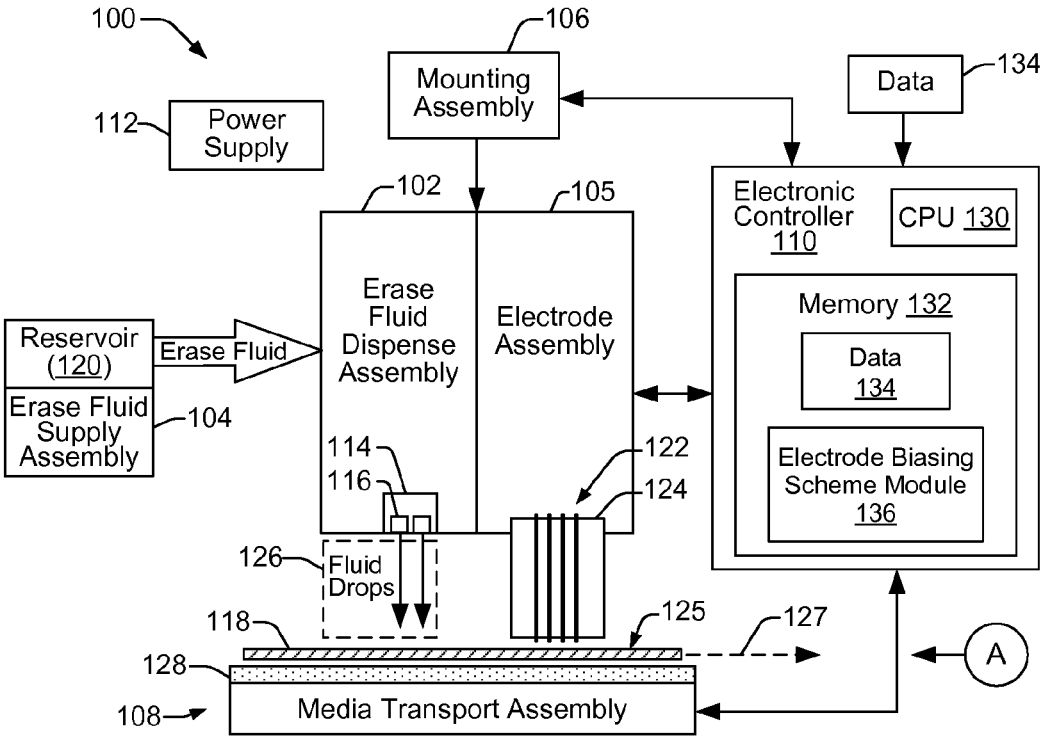
FIG. 1 illustrates an example ink erasing system suitable for implementing an erase process using a plurality of separate sets of electrodes in an electrode biasing scheme as disclosed herein, according to an embodiment.

As noted above, erasing inkjet ink from paper and other media can be difficult once the ink is dry and well established on the media. Prior efforts to improve the effectiveness and efficiency with which inkjet ink can be erased from paper have included the use of specifically formulated inks that interact with a fluid, such as an erasure fluid, deposited on the paper to erase the ink. The extent to which erasable inkjet inks can be effectively erased from paper depends, at least in part, on the ability of the colorant(s) of the erasable inkjet ink to chemically react with erasure component(s) of the erasure fluid. In some instances, the chemical reaction is an oxidation-reduction (redox) reaction, which is considered to be a favorable reaction in terms of free energy. However, the reaction may, in some instances, benefit from additional means that facilitate and/or assist the reaction so that the erasing occurs more effectively (e.g., in terms of erasing) and efficiently (e.g., in terms of time and energy).

Accordingly, a prior ink erasing system that uses erasure fluids to react with ink colorants for erasing inkjet inks from paper, has also incorporated the use of an electrochemical cell to facilitate and/or assist the redox reaction occurring between the ink colorants and the erasure components of the erasure fluid. Depending on the particular combination of erasure fluids and erasable inkjet inks being used, an electrochemical cell can either assist the erase process by speeding up or driving the reaction to completion, or, the electrochemical cell can facilitate the erase process by initiating the reaction in cases where the ink and the fluid may not spontaneously react upon coming into contact with one another. Other prior methods of facilitating and/or assisting the erase process include the use of heaters or other radiation sources to heat or radiate media, system surfaces, and so on. However, the use of heaters or other radiation sources is not as effective or energy efficient as using an electrochemical cell.

In general, electrochemical cells used in prior ink erasing systems are created using two electrodes (e.g., a cathode and an anode) and a fluid (e.g., an erasure fluid) to complete an electrochemical circuit. A power supply is used to apply a suitable voltage between the anode and the cathode to facilitate and/or assist the erasing of the ink from the surface of the paper or other medium. While the use of such electrochemical cells to initiate and/or speed up the erase process is generally effective, the results of the erase process has shortcomings. For example, the erase process works well to erase ink in certain areas of the media being erased, but does not work well, or at all, to erase ink in certain other areas of the media. Common methods of applying an AC or DC electric field across a set of electrodes invariably result in dead zones where the erase effect may not be complete. This can result in a striped pattern being left on the media following the erase operation. Attempts have been made to reduce the electric field dead zones by shrinking the size of the electrodes, thereby decreasing the amount of residual image that is left on the media. However there are technical limits that restrict how small the electrodes can be, and some amount of striping is unavoidable with typical electrode biasing schemes.

Embodiments of the present disclosure help to address the shortcomings noted above in prior inkjet ink erasing systems, in general, through the use of a plurality of separate sets of electrodes implemented in an electrode biasing scheme that ensures only nonadjacent pairs of electrodes are electrified at a time. The biasing scheme enables a number of electrochemical cells to be created across the print medium by alternately electrifying (i.e., applying voltage across) different nonadjacent pairs of electrodes. Alternately electrifying different nonadjacent pairs of electrodes alternately activates different electrochemical cells and generates electric fields that move across the print medium. The electric fields activate and/or enhance the ink erasing process by causing current flow and ion interactions within the dampened surface of the print medium that has been coated with a special erasing fluid. The electric fields overlap areas of the print medium as they move across the medium so that there are no dead zone areas left within the intended erase region that have not been subjected to the electric field during the erase process. The overlapping of the electric fields as they move across the print medium helps ensure a more complete erasure of the inkjet ink from the medium, and results in media output that are free from striped or banded patterns of un-erased ink.

In an example implementation, an ink erasing system includes an erase fluid dispenser to apply erase fluid to a surface of a print medium. The system includes a plurality of nonadjacent pairs of electrodes positioned across a width of the print medium. The system also includes a controller to direct the erase fluid dispenser to apply the erase fluid in an erase region on the print medium, and to alternately electrify the nonadjacent pairs of electrodes to generate a moving electric field through the erase region.

In another example implementation, a processor-readable medium stores code representing instructions that when executed by a processor cause the processor to dispense erase fluid onto a surface of a print medium. The erase fluid defines an erase region. The instructions further cause the processor to apply a plurality of moving electric fields to the erase region. The moving electric fields overlap one another within areas of the erase region. In different implementations, the erase fluid can be dispensed over the entire surface of the print medium, or over one or more portions of the surface of the print medium that do not encompass the entire surface.

Illustrative Embodiments

FIG. 1 illustrates an example ink erasing system 100 suitable for implementing an erase process using a plurality of separate sets of electrodes in an electrode biasing scheme as disclosed herein, according to an embodiment of the disclosure. Ink erasing system 100 includes an erase fluid dispenser or dispense assembly 102, an erase fluid supply assembly 104, an electrode assembly 105, a mounting assembly 106, a media transport assembly 108, an electronic controller 110, and at least one power supply 112 that provides power to the various electrical components of ink erasing system 100. In this embodiment, erase fluid dispense assembly 102 includes a fluid drop jetting printhead 114 to eject erase fluid through a plurality of orifices or nozzles 116 toward a print medium 118 so as to coat the print medium 118 in whole or in part, creating an erase region of dampened surface area on the print medium 118. Print medium 118 can be any type of suitable sheet material, such as paper, card stock, transparencies, Mylar, and the like. Nozzles 116 are arranged in one or more columns or arrays such that properly sequenced ejection of fluid from nozzles 116 causes different areas of the print medium 118, or all of the print medium 118, to be coated with erase fluid as the erase fluid dispense assembly 102 and print medium 118 are moved relative to each other.

Erase fluid supply assembly 104 supplies erase fluid to erase fluid dispense assembly 102 and includes a reservoir 120 for storing erase fluid. Erase fluid flows from reservoir 120 to erase fluid dispenser 102. In one implementation, erase fluid dispense assembly 102 and erase fluid supply assembly 104 are housed together in an erase cartridge or pen. In another implementation, erase fluid supply assembly 104 is separate from dispense assembly 102 and supplies erase fluid to the dispense assembly 102 through an interface connection, such as a supply tube. In either case, reservoir 120 of supply assembly 104 may be removed, replaced, and/or refilled with erase fluid.

Electrode assembly 105 includes electrodes 122 wound around a non-conductive support 124. Individual electrodes 122 are generally spaced evenly across the support 124 (as shown in FIGS. 2-8), which has a length that is oriented perpendicular to the travel path 127 of the print medium 118. Thus, electrodes 122 are spaced across the width of a print medium 118 on the non-conductive support 124, and are situated on the same side of the print medium 118, or adjacent the same surface 125 of the print medium 118, which is a surface 125 of the print medium 118 that generally includes dried ink established on the medium 118. The electrodes 122 contact the surface 125 of the print medium 118 as it passes by the support 124. Electrodes 122 can comprise conductive and/or semi-conductive materials. In one example, electrodes 122 comprise a transition metal (e.g., copper, iron, tin, titanium, platinum, zinc, nickel, and silver), an electrolytic metal (e.g., aluminum), and/or a metal alloy (e.g., stainless steel). In another example, electrodes 122 comprise galvanized metals and metals plated metals with a material to protect against corrosion. The non-conductive support 124 can comprise any of various geometric shapes that enable an effective winding of electrodes 122, such as a cylinder, a box, a prism, a flat object or surface, and so on. An electrode biasing scheme controls the application of voltage (e.g., using power supply 112) across non-adjacent pairs of electrodes 122 in an alternating manner that alternately activates different electrochemical cells and generates electric fields that move across the print medium, as discussed in greater detail below.

Mounting assembly 106 positions erase fluid dispense assembly 102 relative to media transport assembly 108, and media transport assembly 108 positions print medium 118 relative to dispense assembly 102. Thus, a fluid drop zone 126 is defined adjacent to nozzles 116 in an area between dispense assembly 102 and print medium 118. In one example, erase fluid dispense assembly 102 comprises a scanning type fluid dispense assembly 102. In this case, dispense assembly 102 may have a single fluid drop jetting printhead 114, and the mounting assembly 106 includes a carriage for moving the dispense assembly 102 relative to media transport assembly 108 to scan print media 118 as it travels along on media transport assembly 108 in the direction indicated by the dashed arrow 127 in FIG. 1. In another implementation, dispense assembly 102 comprises a non-scanning type assembly that may include a page-wide array assembly of printheads 114. As such, mounting assembly 106 fixes the dispense assembly 102 at a prescribed position relative to media transport assembly 108, and media transport assembly 108 positions print media 118 relative to dispense assembly 102.

Media transport assembly 108 includes an inert base 128 on which the print medium 118 is placed. The base 128 can be formed of any inert material that suitably supports the print medium 118 and provides a surface allowing the electrodes 122 to contact and press against the medium 118 during erasing. As shown generally in FIG. 2, base 128 has dimensions that facilitate the placement of print medium 118 thereon. Some examples of a suitable base 128 and/or base material include a platen formed of a polyacrylic or other plastic, polyurethane, fiberglass, an elastomer or rubber having an appropriate durometer, and so on. In some instances, the base 128 may also comprise a non-flat surface, such as a roller.

As noted above, in the FIG. 1 implementation, erase fluid dispense assembly 102 includes a fluid drop jetting printhead 114 to dispense erase fluid that coats print medium 118 in whole or in part, creating an erase region of dampened surface area on the print medium 118. In one example, the fluid drop jetting printhead 114 comprises a thermal printhead that employs a thermal resistor ejection element within a fluid chamber to vaporize fluid (e.g., erase fluid) and create bubbles that force fluid drops out of a nozzle 116. In another example, printhead 114 comprises a piezoelectric printhead that employs a piezoelectric material actuator as an ejection element to generate pressure pulses that force fluid drops out of a nozzle. In other implementations, erase fluid dispense assembly 102 may employ other mechanisms and methods for dispensing erase fluid onto the print medium 118. For example, dispense assembly 102 may include a coating apparatus such as a roll coater to apply a thin layer or film (e.g., ranging from about 1 micron to about 15 microns) of erase fluid directly to the medium 118 as the medium 118 passes the dispense assembly 102. Examples of roll coaters and roll coating processes include a gravure coating process (that uses an engraved roller running along a coating bath containing the erase fluid), reverse roll coating (which uses at least three rollers to apply the erase fluid to the medium 118), gap coating (where fluid applied to the medium 118 passes through a gap formed between a knife and a support roller to wipe excess fluid away from the medium 118), Meyer Rod coating (where an excess of fluid is deposited onto the medium 118 as the medium 118 passes over a bath roller, and the Meyer Rod wipes away excess fluid), dip coating (where the medium 118 is dipped into a bath containing the fluid), and curtain coating.

Another method of directly applying the erase fluid to the medium 118 involves spraying the fluid (e.g., as an aerosol from a sprayer device, not shown) onto the medium 118. A sprayer device can include an aerosol generating mechanism and/or air brush sprayer mechanism. In another method, erase fluid can be indirectly applied to the surface of the medium 118, for example, by coating the surfaces of electrodes 122 via any of the roll coating or spraying methods previously described. During the erasing process, the erase fluid transfers from the surface of the electrodes 122 to the surface of the medium 118 when the electrodes 122 contact the medium 118. In one example, the electrodes are configured to rotate or move in order to transfer the erase fluid to the surface of the medium 118.

Electronic controller 110 typically includes a processor (CPU) 130, a memory 132, firmware, and other electronics for communicating with and controlling erase fluid dispense assembly 102, mounting assembly 106, and media transport assembly 108. Memory 132 can include both volatile (i.e., RAM) and nonvolatile (e.g., ROM, hard disk, floppy disk, CD-ROM, etc.) memory components comprising computer/processor-readable media that provide for the storage of computer/processor-executable coded instructions, data structures, program modules, and other data for ink erasing system 100. In one implementation of an erase process, electronic controller 110 receives data 134 from a host system, such as a computer, and stores the data 134 in memory 132. Typically, data 134 is sent to ink erasing system 100 along an electronic, infrared, optical, or other information transfer path. Data 134 represents, for example, coded instructions that define erase regions to be erased on a print medium 118. As such, data 134 forms an erase job for ink erasing system 100 that includes one or more job commands and/or command parameters. In other implementations, instructions defining erase regions may be stored in memory 132 as one or more software modules rather than as data 134 from a host system. Using data 134, or a software module containing appropriate processor-executable instructions, electronic controller 110 controls erase fluid dispense assembly 102 to dispense (i.e., eject) droplets of erase fluid from nozzles 116 in a fluid drop jetting printhead 114 during an erase process. Thus, electronic controller 110 defines one or more patterns of ejected erase fluid drops that cover or coat the print medium surface in particular areas with a layer or film of erase fluid to form erase regions on print medium 118. The erase regions and patterns of ejected erase fluid drops that define the erase region, are determined by the erase job commands and/or command parameters from data 134 (or other software/data module). While an erase region typically includes an entire printed surface area of a print medium 118, data 134 can define smaller erase regions on a print medium 118 to facilitate the erasure of printed ink from certain areas of the print medium 118 while leaving printed ink in other areas of the print medium 118 un-erased.

In another implementation, electronic controller 110 includes software instruction modules stored in memory 132 and executable on processor 130 to control various components and functions within ink erasing system 100. For example, memory 132 includes an electrode biasing scheme module 136 comprising instructions executable on processor 130 to control of the activation of electrodes 122 within electrode assembly 105 during an erase process. In general, the module 136 implements a biasing scheme that causes the application of voltage across different nonadjacent pairs of electrodes in an alternating manner to generate electric fields that move across the print medium during the erase process. Thus, an erase process includes applying a voltage across a pair of nonadjacent electrodes to form an electrochemical circuit that generates an electric field. In different implementations, the voltage applied ranges from about 1 V to about 10 V at a current ranging from about 5 mA to about 500 mA. Applying a voltage across alternating pairs of nonadjacent electrodes forms alternating electrochemical circuits that generate moving electric fields across an erase region of a print medium 118. An electrochemical circuit generally includes a voltage source (e.g., power supply 112) applied across two electrodes in contact with (e.g., pressed against) the surface of a print medium 118 that has been coated or dampened with an erase fluid.

Figure 2:
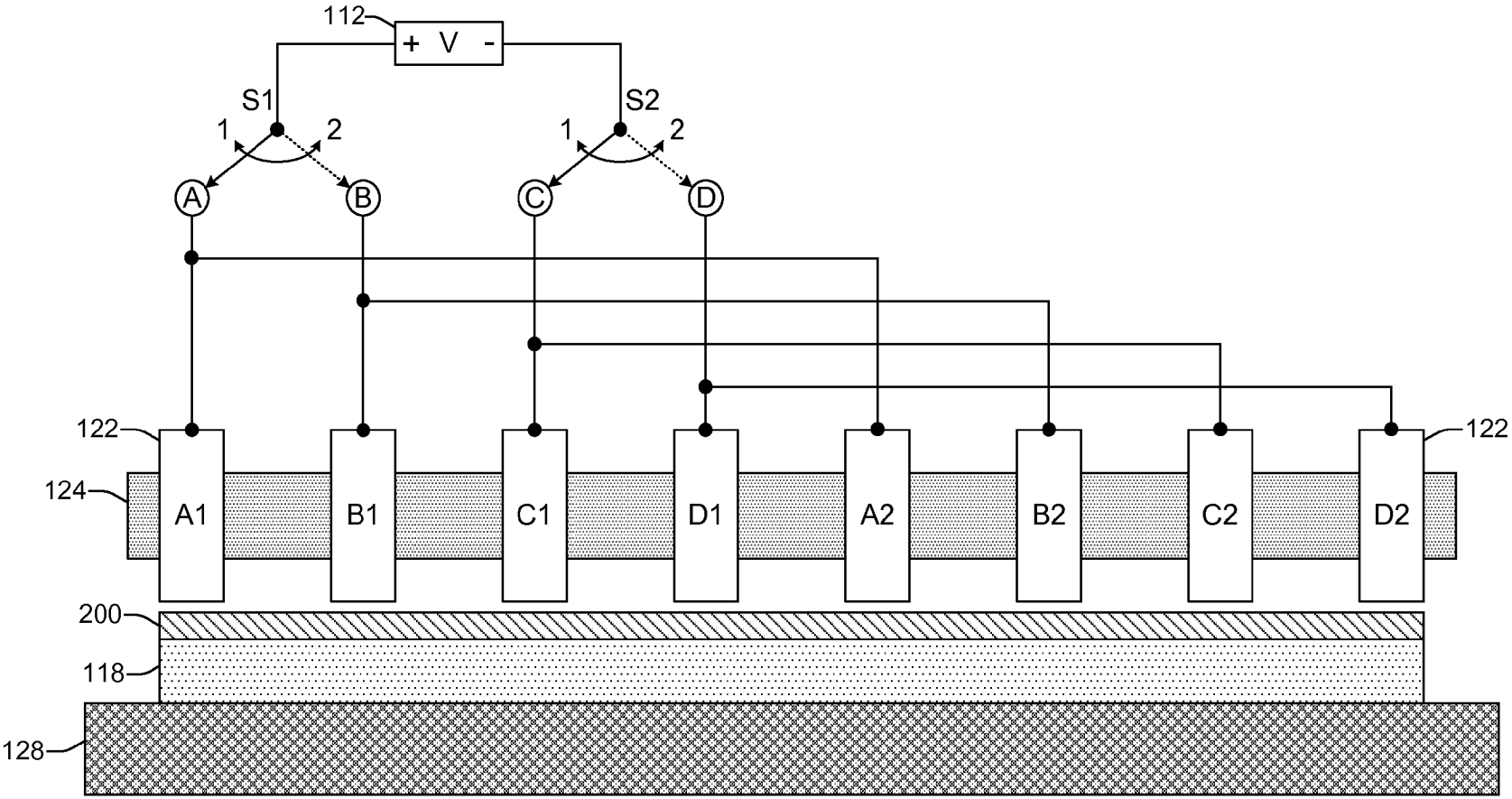
FIGS. 2-8 show a front view of a print medium as seen from a location at point "A" in FIG. 1, as the print medium moves toward point "A" past an electrode assembly on the base of a media transport assembly during an erase process, according to embodiments.
Figure 3:
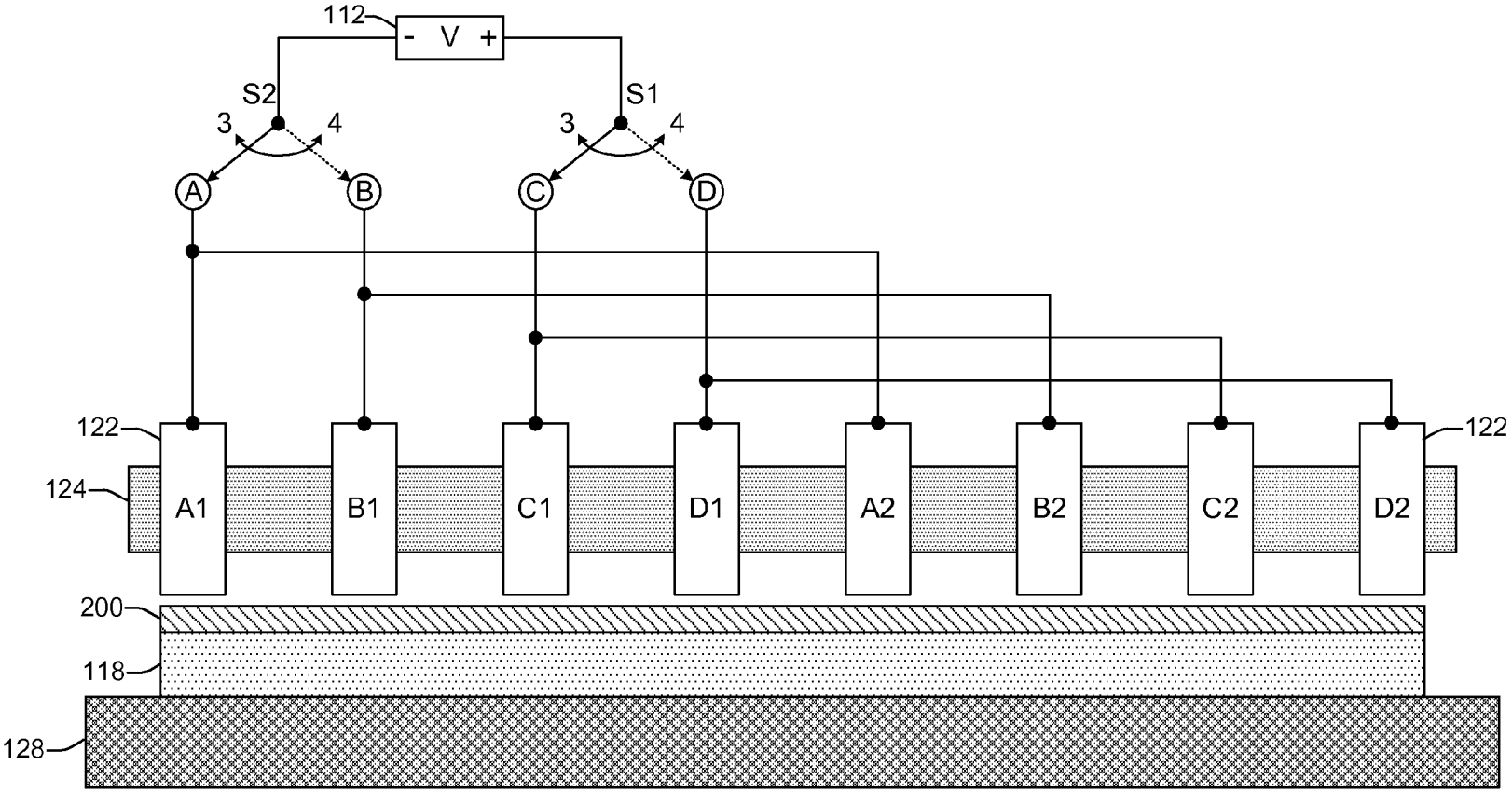

FIGS. 2-8 show generally, a front view of print medium 118 as seen from a location at point "A" in FIG. 1, as the print medium 118 moves toward point "A", past electrode assembly 105 on the base 128 of media transport assembly 108 during an erase process, according to embodiments of the disclosure. The portion of the print medium 118 shown in FIGS. 2-8 has already moved past the erase fluid dispense assembly 102, and the surface of the medium 118 has therefore been coated with a thin erase fluid film/layer 200, alternately referred to as erase region 200. FIGS. 2 and 3 illustrate two switches, S1 and S2, as an example of how an electrode biasing scheme can alternately apply a voltage 112 across nonadjacent pairs of electrodes 112 to generate electric fields that move across the print medium 118 during the erase process. As noted above, an electrode biasing scheme is controlled, for example, by a processor 130 executing computer/ processor-readable instructions from an electrode biasing scheme module 136 stored in memory 132. It is noted that switches, S1 and S2, are shown only as an example to illustrate the implementation of the electrode biasing scheme. The disclosure of switches, S1 and S2, is not intended to indicate the exact manner in which an electrode biasing scheme is physically implemented. Rather, this disclosure contemplates that the physical application of voltages across sets of electrodes 112 to implement the electrode biasing scheme might be achieved in various ways as would be known to one skilled in the art.

As shown in FIGS. 2-8, there are four sets of electrodes 122. The four electrode sets comprise electrode set A1/A2, electrode set B1/B2, electrode set C1/C2, and electrode set D1/D2. Each electrode set is coupled together as a single node. Thus, set A1/A2 comprises a node, set B1/B2 comprises a node, and so on. Accordingly, when a voltage is applied to the single electrode A1, the same voltage is also applied to electrode A2, and vice versa. This is equally true for electrodes B1, B2, C1, C2, D1, and D2. While four sets of electrodes are illustrated and discussed, a greater number of sets of electrodes can also be implemented within the electrode assembly 105. A greater number of electrodes may be appropriate, for example, in implementations where only certain regions of a print medium 118 are to be erased, while certain other regions of the print medium 118 are to be left un-erased. In such implementations, a greater number of electrodes distributed across the medium can achieve a finer resolution of moving electric fields across the medium 118. The greater number of electrodes enables an electrode biasing scheme to more accurately control the application of moving electric fields to a print medium 118 where smaller erase regions have been defined that do not cover the entire surface of a print medium 118.

Figure 4:
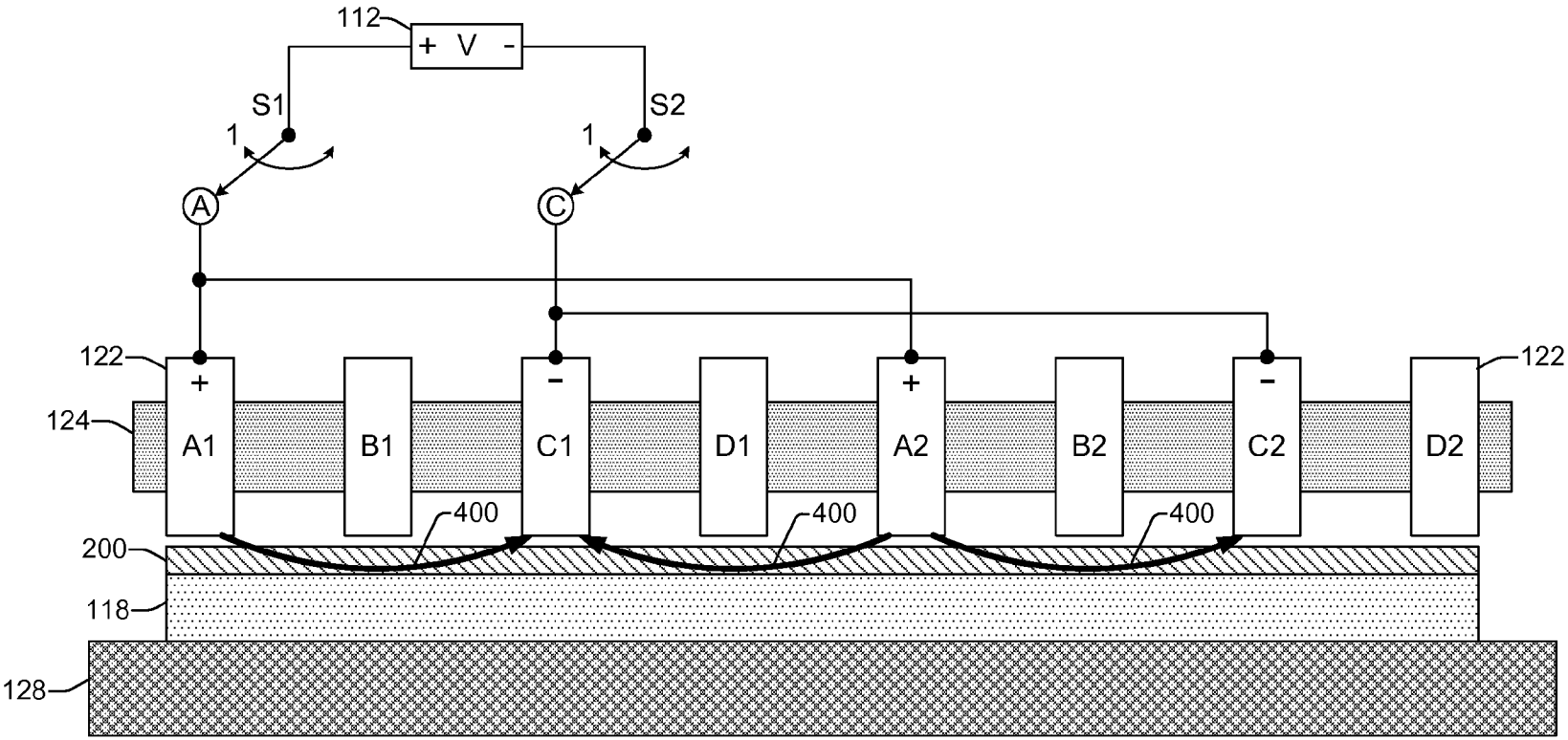

Switches, S1 and S2, are shown in FIGS. 2 and 3 as they toggle between positions 1, 2, 3, and 4, in an electrode biasing scheme. Note that the toggling of switch switches S1 and S2 between positions 1, 2, 3, and 4, is shown spread across two figures (FIGS. 2 and 3) for ease of illustration only, and that switches S1 and S2 actually toggle through positions 1, 2, 3, and 4, in a single physical implementation. As switches, S1 and S2, toggle between positions 1, 2, 3, and 4, activating nonadjacent pairs of electrodes 122, electric fields are generated that move across the print medium 118 within the erase fluid layer 200 and the dampened surface of the medium 118. Referring to FIGS. 2 and 4, for example, in a first step of an electrode biasing scheme, switches S1 and S2 are toggled to position 1, which applies a voltage potential between nonadjacent electrodes A1/A2 and C1/C2. A positive voltage is applied to electrodes A1/A2 through S1, while a negative voltage is applied to electrodes C1/C2 through S2. Thus, electrodes A1 and C1 comprise a nonadjacent pair of electrified electrodes, and A2 and C2 comprise another nonadjacent pair of electrified electrodes. As shown in FIG. 4, the application of voltage across electrodes A1 and C1 generates an electric field 400 within the erase fluid layer 200 and the dampened surface of the medium 118 causing a forward current flow from positively charged electrode A1 to negatively charged C1. Likewise, the application of voltage across electrodes A2 and C2 generates an electric field 400 within the erase fluid layer 200 and the dampened surface of the medium 118 causing a forward current flow from positively charged electrode A2 to negatively charged C2. There is also an electric field 400 between positively charged electrode A2 and negatively charged C1 causing a reverse current flow from electrode A2 to C1.

During each step of the electrode biasing scheme, there is an inactive electrode positioned between each nonadjacent pair of electrified, or active, electrodes. Inactive electrodes do not have any voltage applied to them and do not generate an electric field. As shown in FIG. 4, during a first step of an electrode biasing scheme, electrode B1 is an inactive electrode positioned between the nonadjacent pair of electrified electrodes, A1 and C1; B2 is an inactive electrode positioned between the nonadjacent pair of electrified electrodes, A2 and C2; and electrode D1 is an inactive electrode positioned between the nonadjacent pair of electrified electrodes, A2 and C1.

Figure 5:
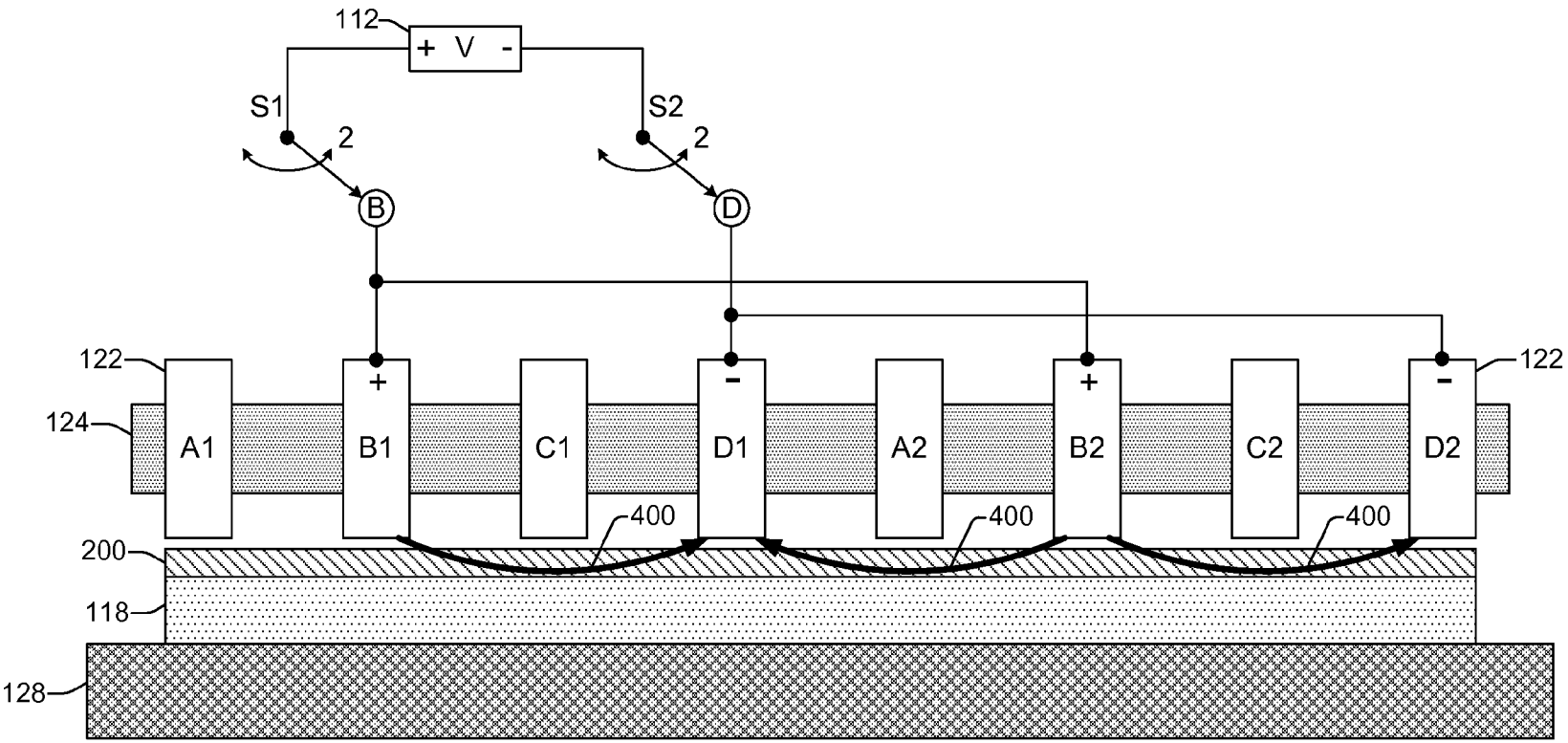

Referring now to FIGS. 2 and 5, in a second step of an electrode biasing scheme, switches S1 and S2 are toggled to position 2, which applies a voltage potential between nonadjacent electrodes B1/B2 and D1/D2. A positive voltage is applied to electrodes B1/B2 through S1, while a negative voltage is applied to electrodes D1/D2 through S2. Thus, electrodes B1 and D1 comprise a nonadjacent pair of electrified electrodes, and B2 and D2 comprise another nonadjacent pair of electrified electrodes. As shown in FIG. 5, the application of voltage across electrodes B1 and D1 generates an electric field 400 within the erase fluid layer 200 (i.e., erase region 200) and the dampened surface of the medium 118 causing a forward current flow from positively charged electrode B1 to negatively charged D1. Likewise, the application of voltage across electrodes B2 and D2 generates an electric field 400 within the erase fluid layer 200 and the dampened surface of the medium 118 causing a forward current flow from positively charged electrode B2 to negatively charged D2. There is also an electric field 400 between positively charged electrode B2 and negatively charged D1 causing a reverse current flow from electrode B2 to D1.

In the second step of the electrode biasing scheme as shown in FIG. 5, electrode C1 is an inactive electrode between the nonadjacent pair of electrified electrodes, B1 and D1; C2 is an inactive electrode between the nonadjacent pair of electrified electrodes, B2 and D2; and electrode A2 is an inactive electrode between the nonadjacent pair of electrified electrodes, B2 and D1.

Figure 6:
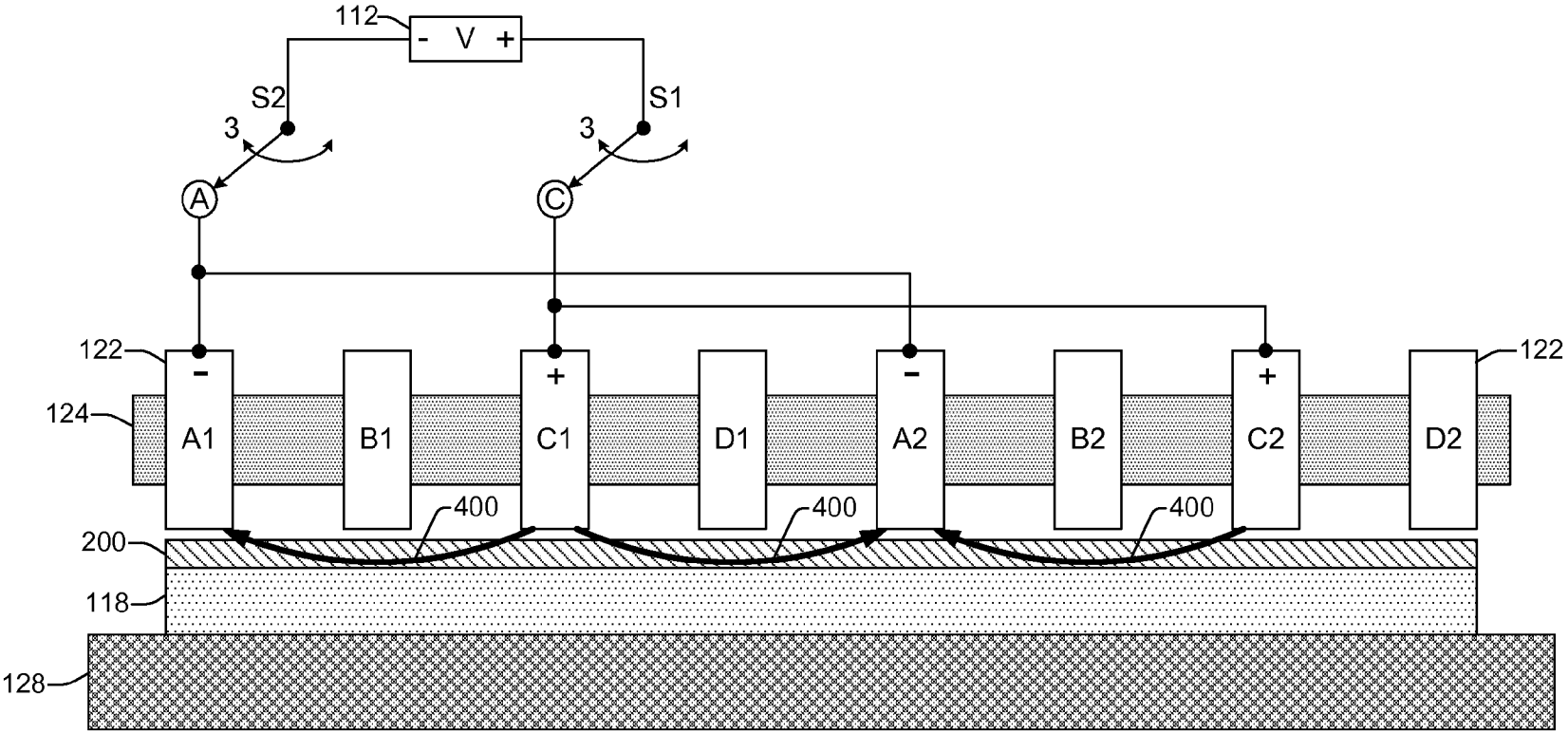

Referring now to FIGS. 3 and 6, in a third step of an electrode biasing scheme, switches S1 and S2 are toggled to position 3, which applies a voltage potential between nonadjacent electrodes A1/A2 and C1/C2. A positive voltage is applied to electrodes C1/C2 through S1, while a negative voltage is applied to electrodes A1/A2 through S2. Thus, electrodes A1 and C1 comprise a nonadjacent pair of electrified electrodes, and A2 and C2 comprise another nonadjacent pair of electrified electrodes. As shown in FIG. 6, the application of voltage across electrodes A1 and C1 generates an electric field 400 within the erase fluid layer 200 and the dampened surface of the medium 118 causing a reverse current flow from positively charged electrode C1 to negatively charged A1. Likewise, the application of voltage across electrodes A2 and C2 generates an electric field 400 within the erase fluid layer 200 and the dampened surface of the medium 118 causing a reverse current flow from positively charged electrode C2 to negatively charged A2. There is also an electric field 400 between positively charged electrode C1 and negatively charged A2 causing a forward current flow from electrode C1 to A2.

In the third step of the electrode biasing scheme as shown in FIG. 6, electrode B1 is an inactive electrode between the nonadjacent pair of electrified electrodes, A1 and C1; D1 is an inactive electrode between the nonadjacent pair of electrified electrodes, C1 and A2; and electrode B2 is an inactive electrode between the nonadjacent pair of electrified electrodes, A2 and C2.

Figure 7:
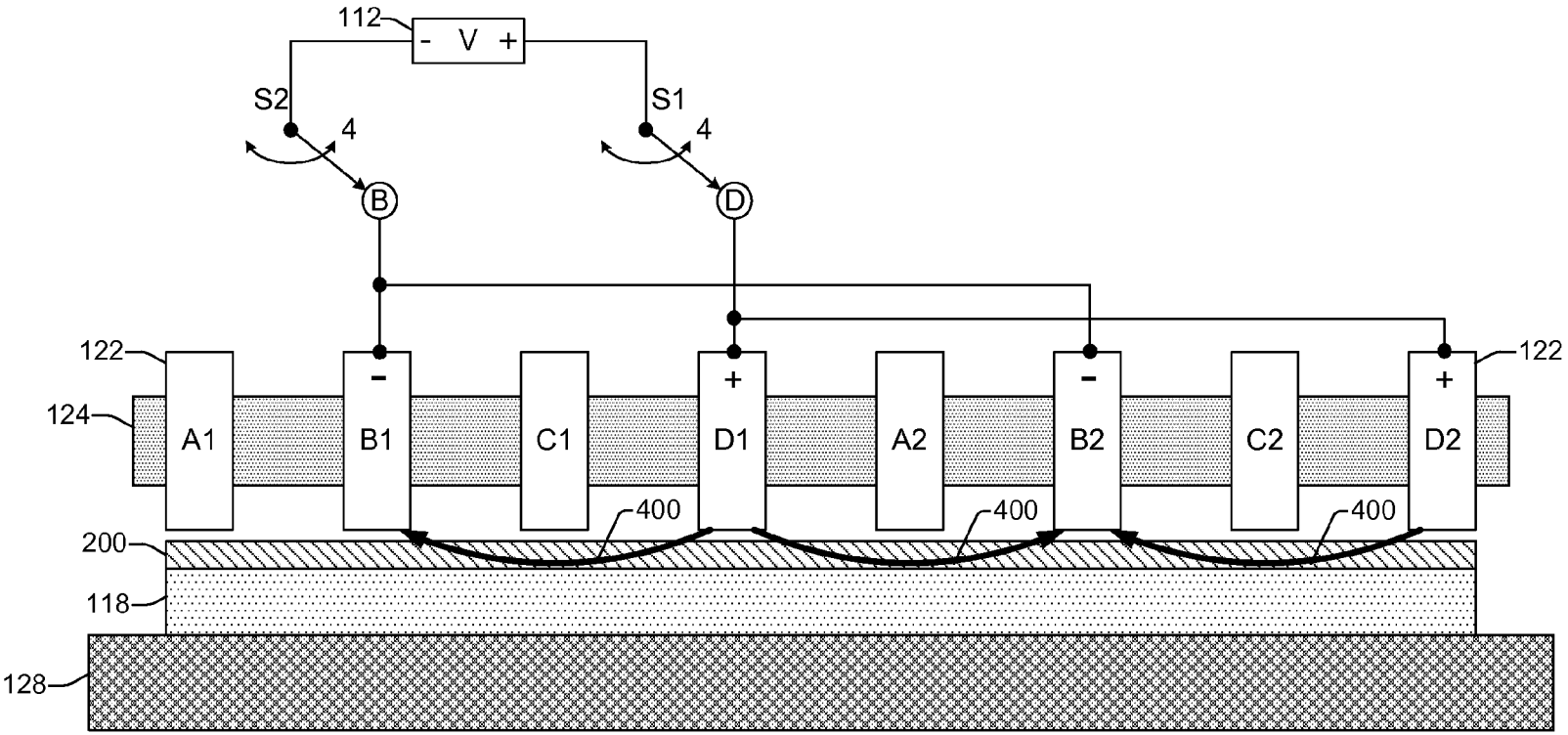

Referring now to FIGS. 3 and 7, in a fourth step of an electrode biasing scheme, switches S1 and S2 are toggled to position 4, which applies a voltage potential between nonadjacent electrodes B1/B2 and D1/D2. A positive voltage is applied to electrodes D1/D2 through S1, while a negative voltage is applied to electrodes B1/B2 through S2. Thus, electrodes B1 and D1, electrodes B2 and D2, and electrodes D1 and B2, comprise nonadjacent pairs of electrified electrodes. As shown in FIG. 7, the application of voltage across electrodes B1 and D1 generates an electric field 400 within the erase fluid layer 200 and the dampened surface of the medium 118 causing a reverse current flow from positively charged electrode D1 to negatively charged B1. Likewise, the application of voltage across electrodes B2 and D2 generates an electric field 400 within the erase fluid layer 200 and the dampened surface of the medium 118 causing a reverse current flow from positively charged electrode D2 to negatively charged B2. There is also an electric field 400 between positively charged electrode D1 and negatively charged B2 causing a forward current flow from electrode D1 to B2.

In the fourth step of the electrode biasing scheme as shown in FIG. 7, electrode C1 is an inactive electrode between the nonadjacent pair of electrified electrodes, B1 and D1; A2 is an inactive electrode between the nonadjacent pair of electrified electrodes, D1 and B2; and electrode C2 is an inactive electrode between the nonadjacent pair of electrified electrodes, B2 and D2.

Figure 8:
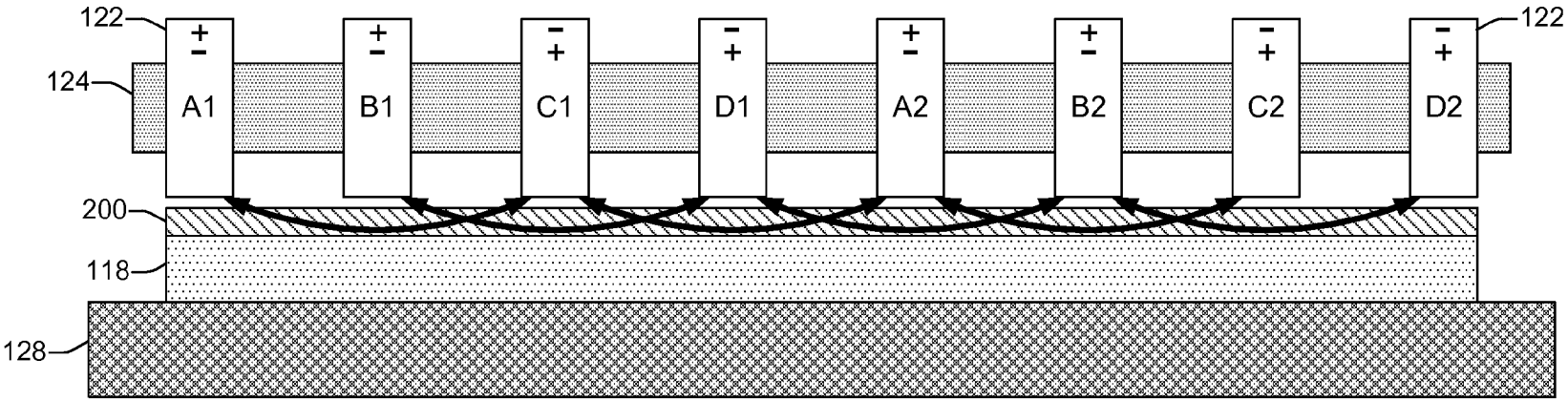

FIG. 8 illustrates how the moving electric fields 400 generated in each step of the electrode biasing scheme overlap one another to cover the whole surface area of an intended erase region 200 of the print medium 118. The erase region 200 is the surface area of the medium 118 that has been coated with erase fluid. Thus, as the print medium 118 travels along on the base 128 of media transport assembly 108 in the direction 127 (FIG. 1), the electrode biasing scheme is implemented to generate the moving electric fields 400 such that electric field 400 is applied to the erase fluid layer 200 (i.e., erase region 200) and the dampened surface of the medium 118 across the full width of the print medium 118, from one side to another. As the medium 118 travels lengthwise past the electrode assembly 105 on base 128 of media transport assembly 108 in the direction 127 (FIG. 1), the electrode biasing scheme continues to apply the moving electric fields 400 across the full width of the erase region 200 of the print medium 118. The electrode biasing scheme ensures that there are no "dead zones" within the erase region 200 across the width of the print medium 118 that go untouched by an electric field 400. Application of an electric field 400 to the erase fluid layer of erase region 200 including the dampened surface of the medium 118 improves the effectiveness and efficiency with which inkjet ink is erased from the medium 118.

Typically, specially formulated inkjet inks are erasable from a print medium 118 through chemical interactions with an erase fluid deposited on the surface of the medium 118. Such reactions include oxidation-reduction (redox) reactions, which can occur without the addition of external energy. However, the extent to which erasable inkjet inks can be effectively erased from a print medium 118 depends, at least in part, on the ability of the colorant(s) of the erasable inkjet ink to chemically react with erasure component(s) of the erasure fluid. The redox reactions are facilitated and/or assisted by the application of an electric field, which causes more effective and efficient erasure of the inkjet ink from the medium. The electric fields activate and/or enhance the ink erasing process by causing current flow and ion interactions within an erase region of the print medium whose surface has been dampened through the application or coating with a special erasing fluid. The overlapping electric fields 400 generated by the electrode biasing scheme, as shown in FIG. 8, help ensure a more complete erasure of the inkjet ink from the medium 118 that does not have striped or banded patterns of un-erased ink. Such patterns might otherwise occur in media output if the electric fields 400 did not overlap across the width of the media, due to those areas in the media (i.e., dead zones) left untouched by the electric field.

Figure 9B:
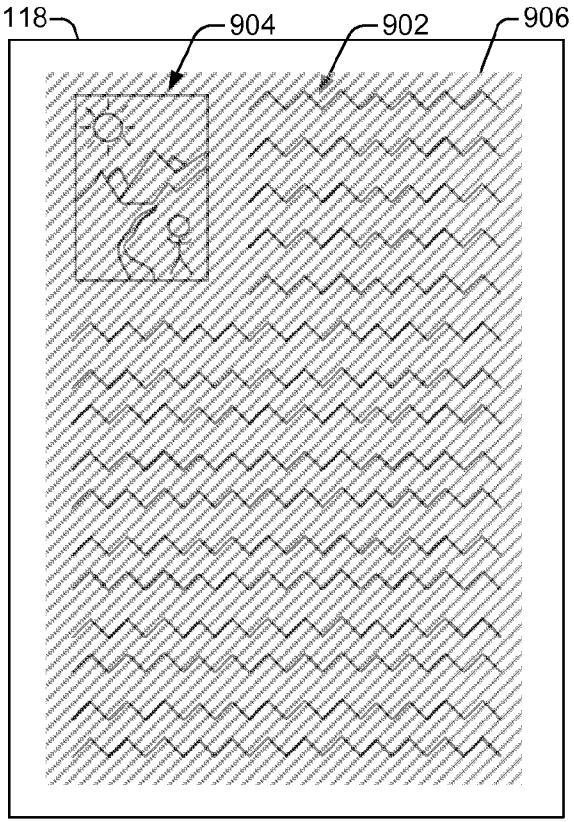
FIG. 9*b* shows the surface of a print medium having a typical printable area that is mostly filled with printed text and graphics, that is coated with erase fluid as an erase region during an erase process, according to an embodiment.
Figure 9A:
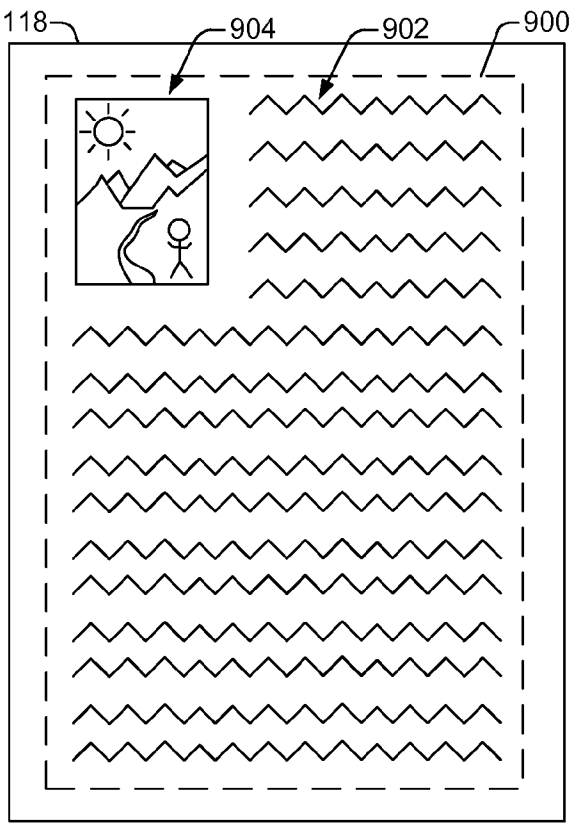
FIG. 9*a* shows the surface of a print medium having a typical printable area that is mostly filled with printed text and graphics, according to an embodiment.

An erase process using an electrode biasing scheme such as that discussed above with reference to FIGS. 2-8, is generally intended to provide a thorough erasure of an erase region that covers an entire printable surface area of a print medium 118. For example, FIG. 9*a* shows the surface of a print medium 118 having a typical printable area 900 that is mostly filled with printed text 902 and graphics 904. It is generally the printable area 900 on a print medium 118 that is coated with erase fluid as an erase region 906 during an erase process, as shown in FIG. 9*b*. However, an erase region 906 can additionally extend beyond the typical printable area into the margin areas that extend out to the edges of the print medium 118. Thus, the erase region 906 shown in FIG. 9*b* can also extend out to the edges of the print medium 118, covering the entire surface area of the medium 118.

Figure 9C:
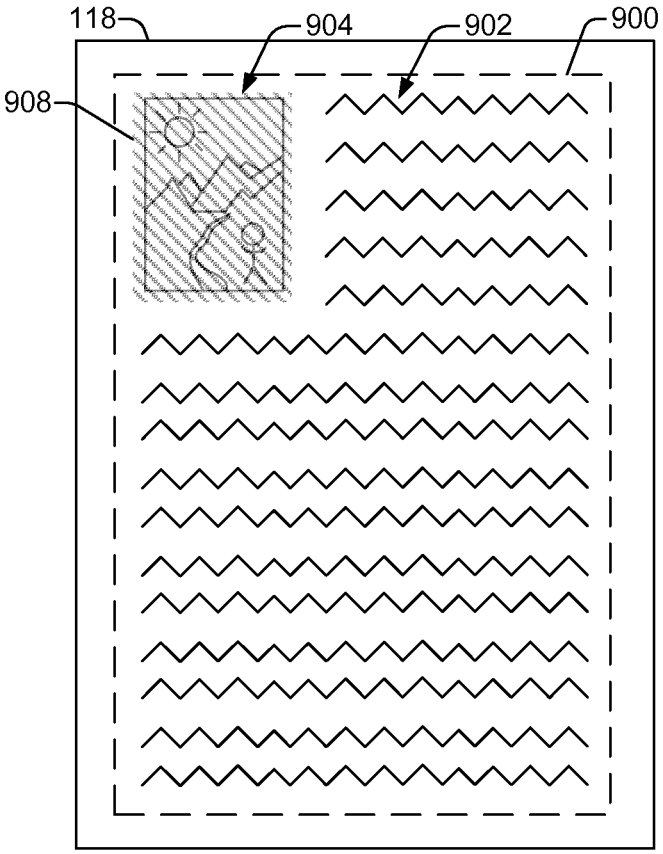
FIG. 9*c* shows the surface of a print medium having a typical printable area that is mostly filled with printed text and graphics, with a customized erase region defined by a dispensed pattern of erase fluid, according to an embodiment.

Furthermore, as shown in FIG. 9*c*, electronic controller 110 can control dispense assembly 102 to define a customized erase region 908 by dispensing a pattern of erase fluid (e.g. through ejected erase fluid drops) that coats a particular area or areas on a print medium 118. As noted above, electronic controller 110 receives in a memory 132, data 134 or other software that represents, for example, erase regions to be erased on a print medium 118. Thus, data 134 can form an erase job that controller 110 executes to control erase fluid dispense assembly 102 to dispense erase fluid from nozzles 116 over a customized erase region 908. Therefore, a customized erase region 908 need not cover an entire printable area of a print medium, but instead can be tailored to cover only certain printed areas a user might want to erase, while leaving other printed areas of the medium 118 un-erased. In this implementation, an electrode assembly 105 typically includes a greater number of sets of electrodes that when distributed across the print medium 118 are controllable to achieve a finer resolution of moving electric fields targeted to smaller areas of the print medium 118, such as a customized erase region 908. An electrode biasing scheme (e.g., from electrode biasing scheme module 136 comprising instructions executable on processor 130 to control of the activation of electrodes 122) controls the activation of the electrodes to apply the moving electric fields to the customized erase region 908. Thus, electronic controller 110 enables ink erasing system 100 to implement erase processes that erase an entire surface area of a print medium 118, as well as erasing only targeted or customized areas of the print medium 118.

Figure 10:
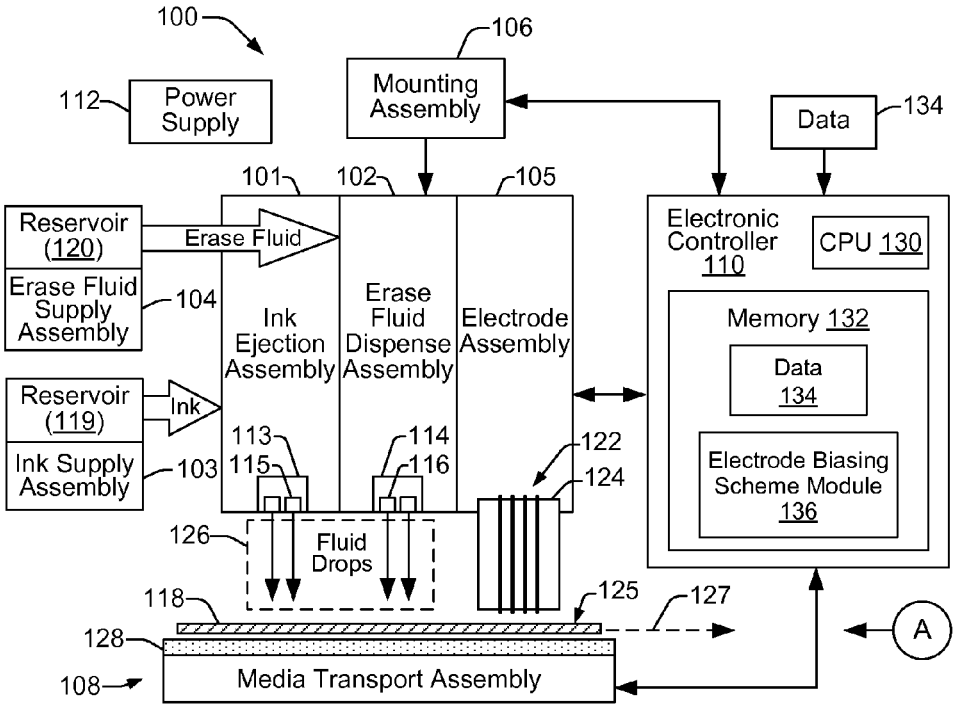
FIG. 10 shows an inkjet printing system suitable for incorporating an ink erasing system that implements an erase process, according to an embodiment.

An ink erasing system 100 can be a stand-alone system, such as that shown in FIG. 1, or it can be a component of another system, such as an inkjet printing system. FIG. 10 shows an inkjet printing system 1000 suitable for incorporating an ink erasing system such as the ink erasing system 100 of FIG. 1, according to an embodiment of the disclosure. While system 1000 includes both an inkjet printing function and an ink erasing function, it is worth noting that in practice, an erase process would not generally be performed on a print medium 118 directly following printing on the print medium 118 within the system 1000. Instead, although the printing and erasing may be accomplished by the same system 1000, the printing and erasing processes would take place at different times. Moreover, an erase process to erase inkjet ink previously printed on a print medium 118 may be accomplished by a different system altogether, including by a stand-alone ink erasing system, for example.

The inkjet printing system 1000 will now be generally described with reference to FIG. 10. However, system components shown in FIG. 10 that have been previously discussed above with regard to the stand-alone ink erasing system 100 of FIG. 1, function in the same general manner within the inkjet printing system 1000 as in the stand-alone ink erasing system 100, and such components will therefore only be discussed with respect to FIG. 10 to the extent of their applicability to an inkjet printing process performed within the inkjet printing system 1000.

As shown in FIG. 10, an inkjet printing system 1000 includes an ink ejection assembly 101, an ink supply assembly 103, a mounting assembly 106, a media transport assembly 108, an electronic controller 110, and at least one power supply 112 that provides power to the various electrical components of inkjet printing system 1000. Such components may function in a dual capacity with respect to both an inkjet printing function and an ink erasing function (i.e., as previously discussed with respect to ink erasing system 100). Ink ejection assembly 101 includes at least one fluid ejection assembly 113 (inkjet printhead 113) having a printhead die that ejects drops of ink through a plurality of orifices or nozzles 115 toward a print medium 118 so as to print onto the print medium 118. Print medium 118 comprises any type of suitable sheet material, such as paper, card stock, transparencies, Mylar, and the like. Typically, nozzles 115 are arranged in one or more columns or arrays such that properly sequenced ejection of ink from nozzles 115 causes characters, symbols, and/or other graphics or images to be printed upon print medium 118 as ink ejection assembly 101 and print medium 118 are moved relative to each other.

Ink supply assembly 103 supplies fluid ink to ink ejection assembly 101 and includes a reservoir 119 for storing ink. Ink supply assembly 103 and ink ejection assembly 101 can form a one-way ink delivery system or a recirculating ink delivery system to deliver ink to ink ejection assembly 101. In a one-way ink delivery system, substantially all of the ink supplied to ink ejection assembly 101 is consumed during printing. In a recirculating ink delivery system, however, only a portion of the ink supplied to ink ejection assembly 101 is consumed during printing. Ink not consumed during printing is returned to ink supply assembly 103.

In one implementation, ink ejection assembly 101 and ink supply assembly 103 are housed together in an inkjet cartridge or pen. In another implementation, ink supply assembly 103 is separate from ink ejection assembly 101 and supplies ink to ink ejection assembly 101 through an interface connection, such as a supply tube. In either case, reservoir 119 of ink supply assembly 103 may be removed, replaced, and/or refilled. Where ink ejection assembly 101 and ink supply assembly 103 are housed together in an inkjet cartridge, reservoir 119 includes a local reservoir located within the cartridge as well as a larger reservoir located separately from the cartridge. The separate, larger reservoir serves to refill the local reservoir. Accordingly, the separate, larger reservoir and/or the local reservoir may be removed, replaced, and/or refilled.

Mounting assembly 106 positions ink ejection assembly 101 relative to media transport assembly 108, and media transport assembly 108 positions print medium 118 relative to ink ejection assembly 101. Thus, a fluid drop zone 126 is defined adjacent to nozzles 115 in an area between ink ejection assembly 101 and print medium 118. In one implementation, inkjet printing system 1000 is a scanning type printer where ink ejection assembly 101 is a scanning printhead assembly. In a scanning type inkjet printing system 1000, mounting assembly 106 includes a carriage for moving the ink ejection assembly 101 relative to media transport assembly 108 in a horizontal manner that scans printhead(s) 113 back and forth across the print medium 118 in forward and reverse passes. Thus, media transport assembly 108 positions print medium 118 relative to ink ejection assembly 101 by moving the print medium 118 along a path 127 that is orthogonal to the horizontal movement of the ink ejection assembly 101. In another implementation, inkjet printing system 1000 is a non-scanning type printer. As such, mounting assembly 106 typically fixes multiple printheads 113 at a prescribed position relative to media transport assembly 108 while media transport assembly 108 positions print media 118 relative to the printheads 113 and moves the print medium 118 along a path 127.

As previously discussed, electronic controller 110 includes processor (CPU) 130, memory 132, firmware, and other electronics. In addition to controlling erase fluid dispense assembly 102, mounting assembly 106, and media transport assembly 108 in an erase process, as discussed above, the components of electronic controller 110 also communicate with and control ink ejection assembly 101, mounting assembly 106, and media transport assembly 108 in an inkjet printing process. Thus, in one implementation, data 134 received from a host system such as a computer, represents a document or image file to be printed. As such, data 134 forms a print job for inkjet printing system 1000 that includes one or more print job commands and/or command parameters. Using data 134, electronic controller 110 controls ink ejection assembly 101 to eject ink drops from nozzles 115. Thus, electronic controller 110 defines a pattern of ejected ink drops that form characters, symbols, and/or other graphics or images on print medium 118. The pattern of ejected ink drops is determined by the print job commands and/or command parameters from data 134.

Figure 11:
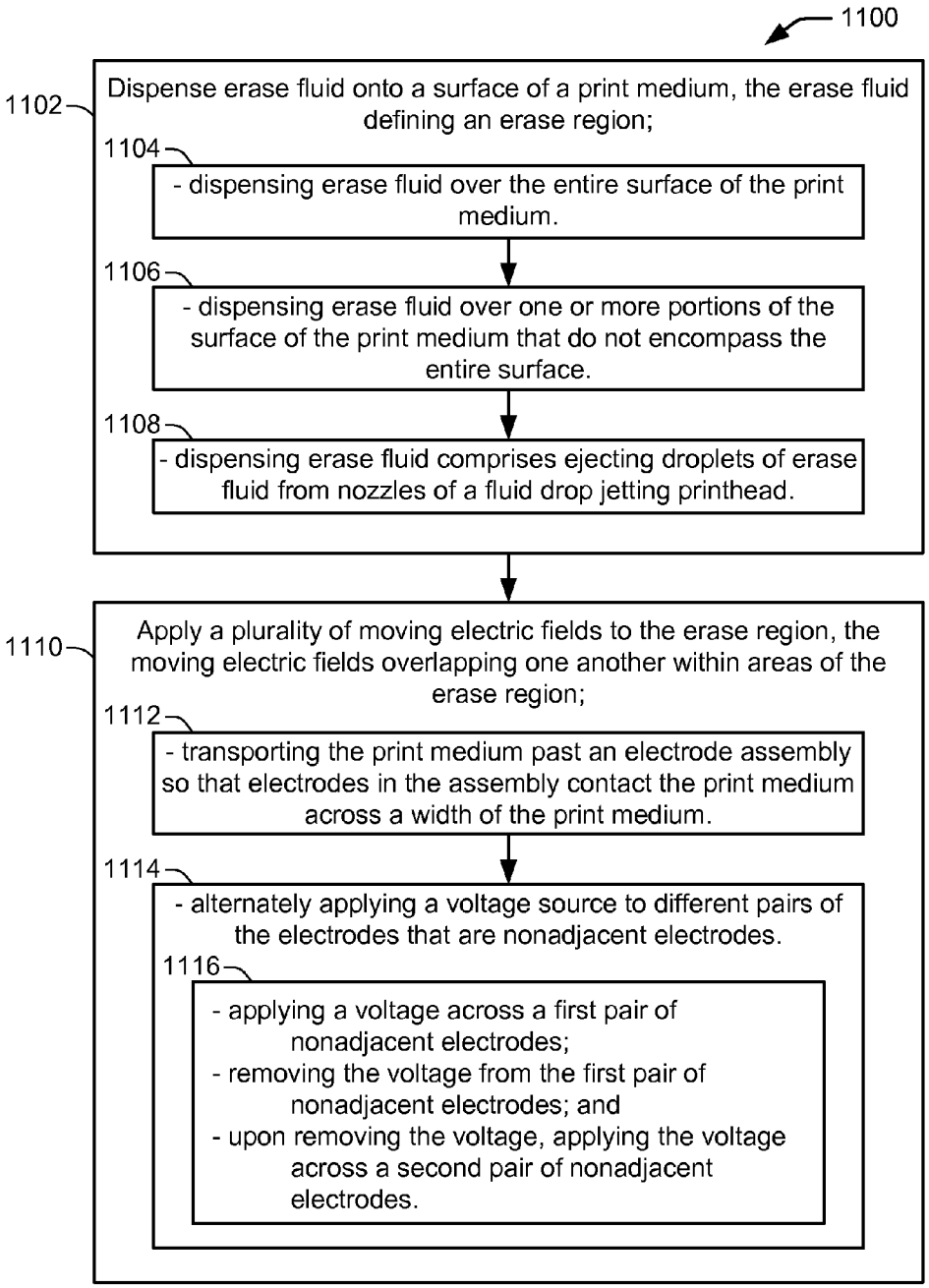
FIG. 11 shows a flowchart of an example method related to an ink erase process in an ink erasing system that uses electrodes in an electrode biasing scheme to generate moving electric fields, according to an embodiment.

FIG. 11 shows a flowchart of an example method 1100 related to an ink erase process in an ink erasing system that uses electrodes in an electrode biasing scheme to generate moving electric fields, according to an embodiment. Method 1100 is associated with the embodiments discussed above with regard to FIGS. 1-10, and details of the steps shown in method 1100 can be found in the related discussion of such embodiments. The steps of method 1100 may be embodied as programming instructions stored on a computer/processor-readable medium, such as memory 132 of FIGS. 1 and 10. In an embodiment, the implementation of the steps of method 1100 is achieved by the reading and execution of such programming instructions by a processor, such as processor 130 of FIGS. 1 and 10. Method 1100 may include more than one implementation, and different implementations of method 1100 may not employ every step presented in the flowchart. Therefore, while steps of method 1100 are presented in a particular order, the order of their presentation is not intended to be a limitation as to the order in which the steps may actually be implemented, or as to whether all of the steps may be implemented. For example, one implementation of method 1100 might be achieved through the performance of a number of initial steps, without performing one or more subsequent steps, while another implementation of method 1100 might be achieved through the performance of all of the steps.

Method 1100 FIG. 11, begins at block 1102, where the first step shown is to dispense erase fluid onto a surface of a print medium. Dispensing the erase fluid onto the print medium defines an erase region on the surface of the medium. the erase fluid defining an erase region. As shown at block 1104, dispensing the erase fluid can include dispensing erase fluid over the entire surface of the print medium. In other implementations, as shown at block 1106, dispensing the erase fluid can include dispensing erase fluid over one or more portions of the surface of the print medium that do not encompass the entire surface. As shown at block 1108, in one implementation, dispensing erase fluid can be achieved by ejecting droplets of erase fluid from nozzles of a fluid drop jetting printhead.

The method 1100 continues at block 1110 where the next step is to apply a plurality of moving electric fields to the erase region. The moving electric fields overlap one another within areas of the erase region. As shown at blocks 1112 and 1114, respectively, applying the plurality of moving electric fields includes transporting the print medium past an electrode assembly so that electrodes in the assembly contact the print medium across a width of the print medium, and alternately applying a voltage source to different pairs of the electrodes that are nonadjacent electrodes. As shown at block 1116, alternately applying a voltage source to different pairs of the electrodes includes applying a voltage across a first pair of nonadjacent electrodes, then removing the voltage from the first pair of nonadjacent electrodes, and upon removing the voltage from the first pair of nonadjacent electrodes, applying the voltage across a second pair of nonadjacent electrodes. In other implementations, and depending on the number of electrodes present, the method may include further steps of removing the voltage from the second pair of nonadjacent electrodes, and upon removing the voltage from the second pair of nonadjacent electrodes, applying the voltage across a third pair of nonadjacent electrodes, and so on.

What is claimed is:

1. An ink erasing system comprising:

an erase fluid dispenser to apply erase fluid to a surface of a print medium;

a plurality of nonadjacent pairs of electrodes positioned across a width of the print medium;

a controller to direct the erase fluid dispenser to apply the erase fluid in an erase region on the print medium, and to alternately electrify the nonadjacent pairs of electrodes to generate a moving electric field through the erase region.

2. An ink erasing system as in claim 1, further comprising a fluid drop jetting printhead to apply the erase fluid by ejecting it from the erase fluid dispenser.

3. An ink erasing system as in claim 1, further comprising a non-conductive support around which the electrodes are wound.

4. An ink erasing system as in claim 1, further comprising a media transport assembly with an inert base on which the print medium is transported during an erase process.

5. An ink erasing system as in claim 1, further comprising a voltage source to electrify the electrodes.

6. An ink erasing system as in claim 1, wherein the erase region covers an entire surface of one side of the print medium.

7. An ink erasing system as in claim 1, wherein the erase region covers only a portion of the surface of the print medium.

8. An ink erasing system as in claim 1, further comprising an ink ejection assembly and an ink supply assembly to print onto the surface of the print medium.

9. An ink erasing system as in claim 1, wherein the ink ejection assembly comprises an inkjet printhead to ejects drops of ink through a plurality of nozzles toward the print medium.

* * * * *